US009589757B1

(12) United States Patent
Hannon et al.

(10) Patent No.: US 9,589,757 B1
(45) Date of Patent: Mar. 7, 2017

(54) NANO-PATTERNED SUPERCONDUCTING SURFACE FOR HIGH QUANTUM EFFICIENCY CATHODE

(71) Applicant: JEFFERSON SCIENCE ASSOCIATES, LLC, Newport News, VA (US)

(72) Inventors: Fay Hannon, Poquoson, VA (US); Pietro Musumeci, Los Angeles, CA (US)

(73) Assignee: JEFFERSON SCIENCE ASSOCIATES, LLC, Newport News, VA (US)

( * ) Notice: Subject to any disclaimer, the term of this patent is extended or adjusted under 35 U.S.C. 154(b) by 0 days.

(21) Appl. No.: 14/862,640

(22) Filed: Sep. 23, 2015

(51) Int. Cl.
*B24B 37/04* (2012.01)
*H01J 9/12* (2006.01)
*H01J 40/06* (2006.01)

(52) U.S. Cl.
CPC ..... *H01J 9/12* (2013.01); *B24B 37/042* (2013.01); *H01J 40/06* (2013.01)

(58) Field of Classification Search
CPC ..... H01J 9/12; H01J 40/06; B24B 37/042; B24B 37/30; B24B 37/04; B24B 37/26; B24B 37/24
USPC ..... 451/41
See application file for complete search history.

(56) References Cited

U.S. PATENT DOCUMENTS 3,939,053 A * 2/1976 Diepers ..... C25F 7/00 204/212
4,014,765 A * 3/1977 Roth ..... C25F 3/26 204/212
5,923,045 A * 7/1999 Nihashi ..... H01J 1/34 257/10
6,524,170 B2 2/2003 Srinivasan-Rao et al.
8,664,853 B1 * 3/2014 Montgomery ..... H01J 40/06 313/13
2002/0132565 A1 * 9/2002 Srinivasan-Rao ..... H01J 9/12 451/54
2006/0033417 A1 * 2/2006 Srinivasan-Rao ..... H01J 3/021 313/399
2007/0001611 A1 * 1/2007 Bewlay ..... H01J 9/247 313/624
2007/0096087 A1 * 5/2007 Catrysse ..... B82Y 20/00 257/40

OTHER PUBLICATIONS

Lee, R. K., "Surface-Plasmon Resonance-Enhanced Multiphoton Emission of High-Brightness Electron . . . ", Feb. 15, 2013, pp. 074801-1-074801-5, vol. 110, Physical Review Letters.
Polyakov, A., "Plasmon-Enhanced Photocathode for High Brightness and High Repetition Rate X-Ray Sources", Feb. 15, 2013, pp. 076802-01-076802-05, vol. 110, Physical Review Letters.

* cited by examiner

*Primary Examiner* — George Nguyen

(57) ABSTRACT

A method for providing a superconducting surface on a laser-driven niobium cathode in order to increase the effective quantum efficiency. The enhanced surface increases the effective quantum efficiency by improving the laser absorption of the surface and enhancing the local electric field. The surface preparation method makes feasible the construction of superconducting radio frequency injectors with niobium as the photocathode. An array of nano-structures are provided on a flat surface of niobium. The nano-structures are dimensionally tailored to interact with a laser of specific wavelength to thereby increase the electron yield of the surface.

12 Claims, 3 Drawing Sheets

NANO-PATTERNED SUPERCONDUCTING SURFACE FOR HIGH QUANTUM EFFICIENCY CATHODE

GOVERNMENT LICENSE RIGHTS

This invention was made with government support under Management and Operating Contract No. DE-AC05-06OR23177 awarded by the Department of Energy. The United States Government has certain rights in the invention.

FIELD OF THE INVENTION

The present invention relates to high-performance accelerator systems and more specifically to a method for preparing a niobium surface with a nano-structure to produce a high quantum efficiency superconducting niobium surface.

BACKGROUND OF THE INVENTION

Radio frequency photocathode electron guns are the source of choice for most high-performance accelerator systems. The main reason for this popularity is their ability to produce very bright beams of electrons. However, due to inherent limitations, photocathode radio frequency electron guns have not successfully penetrated certain key applications. One of these limitations is their inability to economically produce the high average current, high brightness electron beams necessary for certain applications. Another drawback is that one must choose between high quantum efficiency and durability. Durable cathodes tend to have relatively low quantum-efficiency, while high quantum efficiency cathode materials are very sensitive to vacuum conditions.

Superconducting Radio Frequency injectors are highly sought after for high brightness, high duty factor electron sources. The major hurdle in its development is the lack of a suitable photocathode that has high quantum efficiency, long life time and is compatible with the superconductivity of the injector.

Although generation of electrons from metals using multiphoton photoemission by use of nanostructured plasmonic surfaces has been reported for copper and aluminum, these structures are not suitable for forming fully superconducting radio frequency injectors. Furthermore, the aluminium nanostructures are grooves which unfortunately are sensitive to the polarization of the laser.

Accordingly, it would be desirable to provide a photocathode that has high quantum efficiency, long life time, and is compatible with a superconducting radio frequency injector.

OBJECT OF THE INVENTION

A first object of the invention is to provide a photocathode for use in a superconducting radio frequency injector.

A second object of the invention is to provide a photocathode with a superconducting surface for use in superconducting high-performance accelerator systems.

A further object of the invention is to provide a method for increasing the effective quantum efficiency of a niobium surface by improving laser absorption and enhancing the local electric field.

A further object of the invention is to improve the feasibility of constructing superconducting radio frequency injectors with niobium as the photocathode.

A further object of the invention is to provide a superconducting nano-structured surface that is not dependent on laser polarization.

A further object of the invention is to improve the multi-photon emission process for extracting electrons from a photocathode surface.

Further advantages of the invention will be apparent from the following detailed description of illustrative embodiments thereof.

BRIEF SUMMARY OF THE INVENTION

The present invention is a method for providing a superconducting surface on a laser-driven niobium cathode in order to increase the effective quantum efficiency. The enhanced surface increases the effective quantum efficiency by improving the laser absorption of the surface and enhancing the local electric field. The surface preparation method makes feasible the construction of superconducting radio frequency injectors with niobium as the photocathode. An array of nano-structures are provided on a flat surface of niobium. The nano-structures are dimensionally tailored to interact with a laser of specific wavelength to thereby increase the electron yield of the surface.

DETAILED DESCRIPTION

The present invention is a method for preparing a niobium photocathode surface with a nano-patterned structure to produce a high quantum efficiency superconducting surface.

Figure 1:
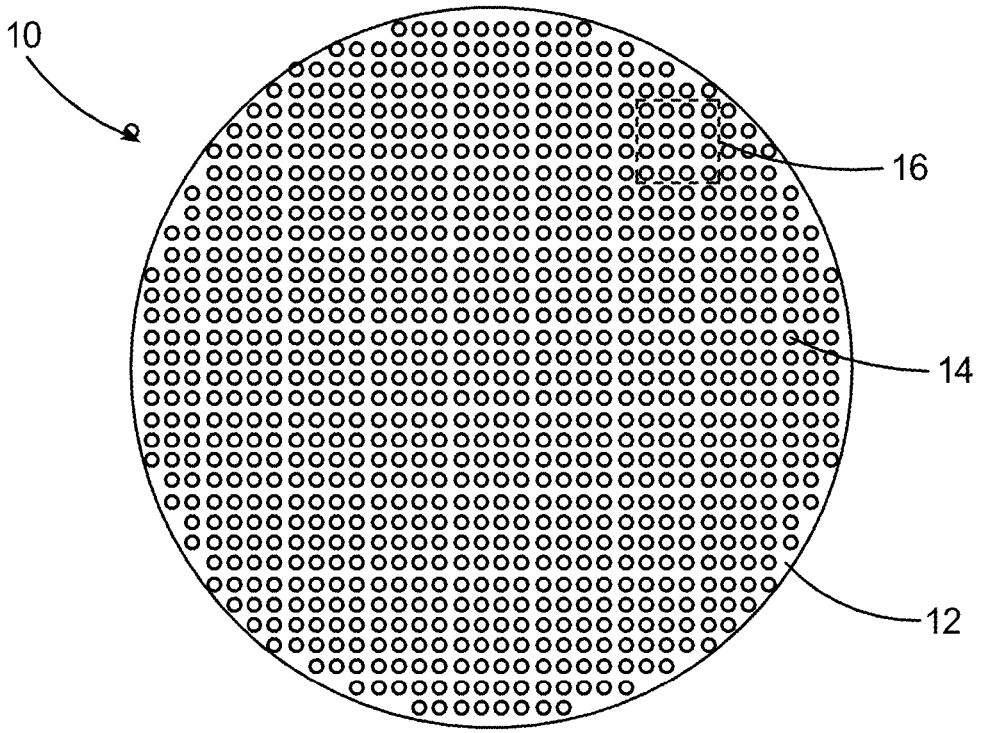
FIG. 1 is a front elevation view of a superconducting niobium photo cathode surface according to the present invention.
Figure 2:
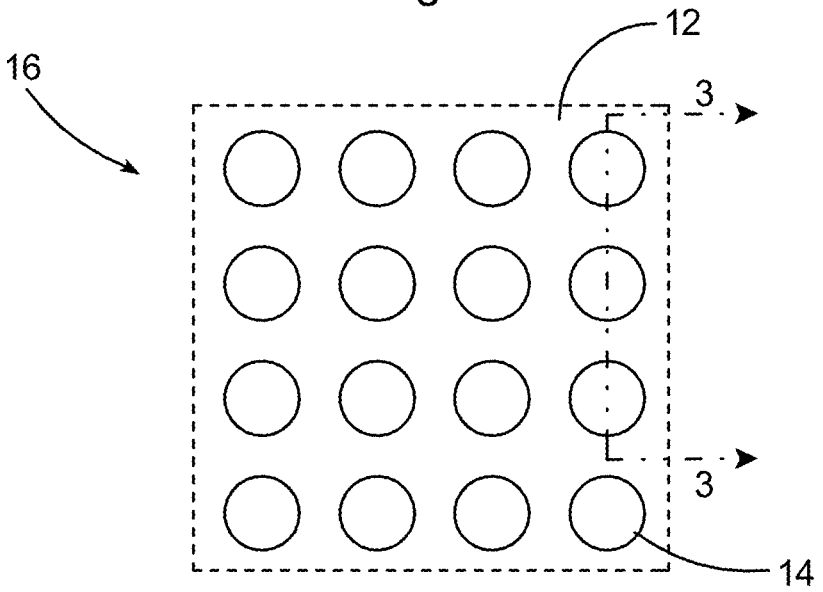
FIG. 2 is an enlarged view of a small portion of the surface of the photo cathode of FIG. 1.
Figure 3:
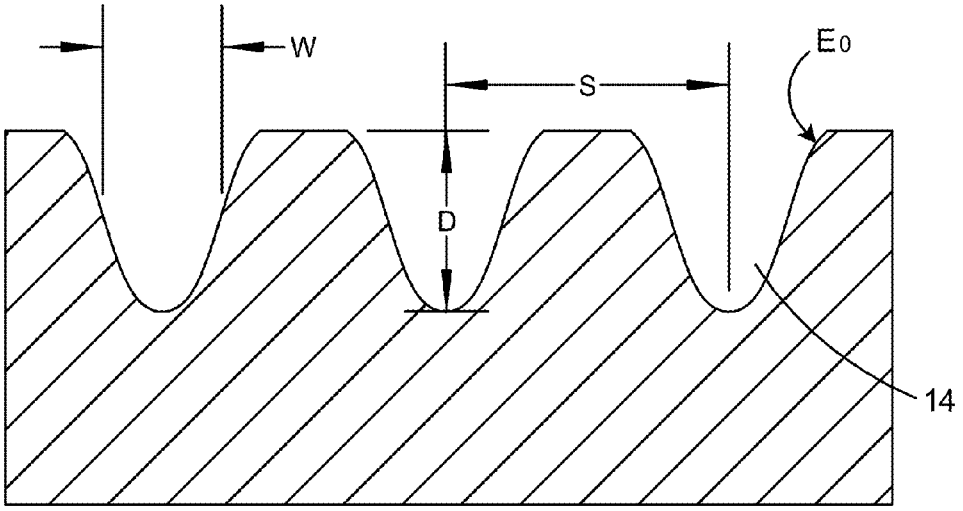
FIG. 3 is a sectional view through the photo cathode taken along line 3-3 of FIG. 2.

Referring to FIGS. 1-3, a niobium photocathode 10 includes a surface 12 that is polished to include a surface roughness of 10 nm or less as measured by a profilometer. A nano-patterned array of nano-holes 14 are then formed in the smooth surface 12 of the photocathode. The meaning of the term nano-holes as used herein refers to holes that include a width, diameter, and depth that is measured in the nanometer range. The meaning of the term nano-patterned as used herein refers to holes that create a pre-determined pattern with the holes spaced apart by a distance in the nanometer range. The transition temperature of niobium into a superconductor is 9.3K. Thus, when the nano-patterned niobium photocathode is cooled below 9.3K, the photocathode becomes superconducting.

In forming the nano-holes at ambient temperature, the contraction of niobium at low temperatures is factored in such that the dimensions of the nano-holes are optimized for the niobium surface when it is in a superconducting state.

The nano-patterned surface greatly increases the absorption of laser light so that more photons will contribute to the photo-emission process. Additionally, as shown in FIG. 3, each nano-hole acts as a plasmonic resonance nano-cavity such that the maximum electric field EO is at the mouth of the nano-cavity. This local enhancement in field increases the Child-Langmuir limit so that more electrons may escape the surface. The nano-patterned structure is applicable to incident laser wavelengths ranging from 200 to 1500 nm. The width, depth and spacing of the nano-structure are designed for a specific wavelength and angle of incidence to increase the absorption of the laser light.

With reference to FIG. 2, in the preferred embodiment the geometry of the nano-structures consists of a rectangular array 16 of nano-holes. The meaning of the term nano-holes as used herein refers to holes that include a width, diameter, and depth that is measured in the nanometer range. Furthermore, nano-holes are preferred over nano-grooves as they are not sensitive to the polarization of the laser. Imperfections in the uniformity of the holes may in practice lead to some slight dependence on laser polarization.

With reference to FIG. 3, the dimensions of the nano-holes are optimized through finite-difference-time-domain (FDTD) numerical simulations. For an 800 nm laser, the preferred dimensions for the nano-holes in the niobium surface are 280 nm FWHM width W, 365 nm depth D, and 750 nm center to center spacing S. The structure is preferably fabricated with focused ion beam (FIB) milling. It will be obvious to one skilled in the art that single crystal niobium may be advantageous depending on the fabrication process to achieve the desired result. FIB fabrication produces approximately Gaussian profiled holes. There is some small degradation (<5%) in optical absorption over cylindrical holes. For shorter wavelength lasers, the dimensions of the hole and spacing decreases and for longer wavelength lasers, the dimensions of the hole and spacing increases. The work function of niobium is such that the peak quantum efficiency of a bare surface occurs at ultra-violet wavelengths (~250 nm). The preferred embodiment suggests that the holes be tailored to an infra-red wavelength (such as 800 nm), which are easier to fabricate. Multi-photon emission can then be used to extract electrons from the nano-patterned surface. It has been shown experimentally with copper that the charge yield from multi-photon emission can be greater than that for single photon emission with ultra-violet laser.

Figure 4:
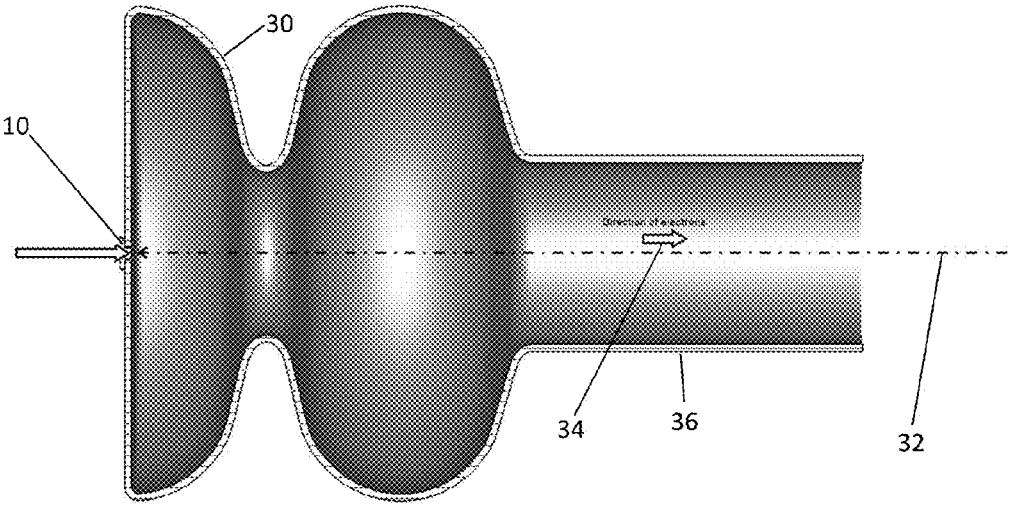
FIG. 4 is a sectional view of a superconducting niobium nano-patterned photo cathode inside a 1.3 GHz superconducting radio frequency electron injector.
Figure 5:
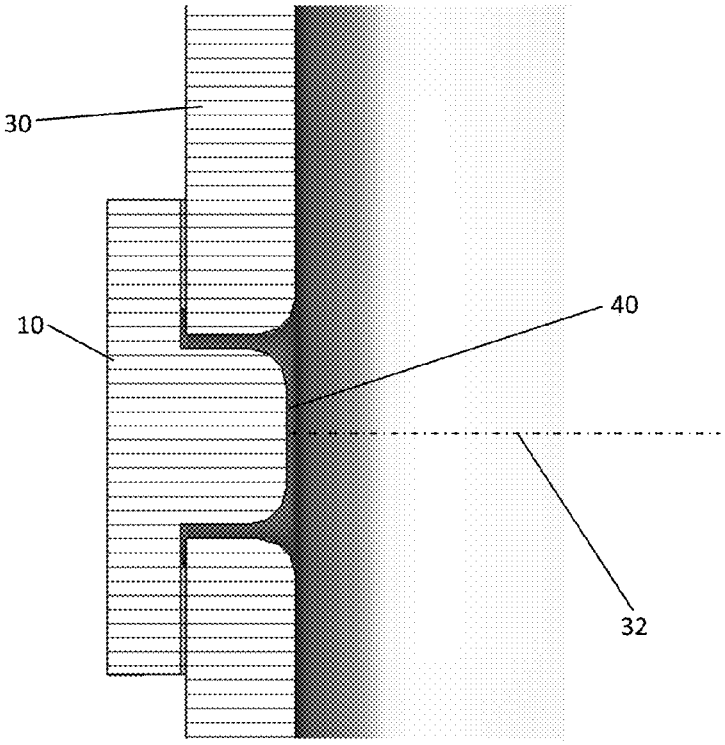
FIG. 5 is a sectional view of an electron gun and SRF cavity with a superconducting nano-patterned surface installed in the electron gun.

With reference to FIG. 4, the niobium nano-patterned photocathode 10 is inserted into a superconducting radio frequency (SRF) electron gun 30 to improve the interaction with laser light of a specific wavelength and thereby increase the electron yield of the surface of the photocathode. The path of the laser light 32 is at a slight angle to the electron beam 34 generated by the electron gun 30. The electron beam is thence accelerated by the electron gun. . As shown in FIG. 5, the niobium nano-patterned photocathode 10 is mounted in the SRF electron gun 30 with the nano-patterned surface 40 facing the incident laser light 32.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiments herein were chosen and described in order to best explain the principles of the invention and the practical application, and to enable others of ordinary skill in the art to understand the invention for various embodiments with various modifications as are suited to the particular use contemplated.

What is claimed is:

1. A method for providing a superconducting surface on a laser-driven cathode in order to increase the effective quantum efficiency, comprising the steps of:

providing a plug constructed of niobium;

polishing a first side of the niobium plug to create a polished surface;

creating an array of nano-holes in the polished surface to form a nano-patterned surface; and setting the width, depth, and spacing of the nano-holes according to the wavelength and angle of incidence of the incident laser to increase the absorption of the laser light.

2. The method of claim 1 further comprising polishing said first side to a surface roughness of less than 10 nm as measured by a profilometer.

3. The method of claim 1 wherein the center to center spacing between the nano-holes is between 200 to 1500 nm.

4. The method of claim 1 further comprising forming the nano-holes with focused ion beam milling.

5. The method of claim 4 wherein the nano-holes are Gaussian in shape.

6. The method of claim 1 wherein the nano-holes are formed in a rectangular array.

7. The method of claim 6 wherein the rectangular array of nano-holes includes a circular outer shape to form a circular beam pattern.

8. The method of claim 1 wherein said nano-patterned surface is a superconductor at 9.3K or less.

9. The method of claim 1 wherein the laser is a titanium-sapphire laser with a wavelength of 800 nm and the center to center spacing between the nano-holes is 740 to 760 nm.

10. The method of claim 1 wherein the width, depth, and spacing of the nano-holes are formed of a size to increase the absorption of the laser light at 9.3K or less.

11. The method of claim 1 wherein the dimensions of the nano-holes are optimized through finite-difference-time-domain (FDTD) numerical simulations.

12. The method of claim 11 wherein the incident laser includes a wavelength of 800 nm; and the nano-holes are 280 nm FWHM width, 365 nm depth, and 750 nm center to center spacing.

* * * * *